US005678421A

United States Patent [19]

Maynard et al.

[11] Patent Number: 5,678,421

[45] Date of Patent: Oct. 21, 1997

[54] REFRIGERATION UNIT FOR COLD SPACE MERCHANDISER

[75] Inventors: James Maynard, Alpharetta, Ga.; Milan Savic, Willowdale; Ian Eldergill, Vancouver, both of Canada

[73] Assignee: Habco Beverage Systems Inc., North York, Canada

[21] Appl. No.: 578,756

[22] Filed: Dec. 26, 1995

[51] Int. Cl.[6] ..... F25D 17/04

[52] U.S. Cl. ..... 62/407; 62/298; 62/448; 62/279

[58] Field of Search ..... 62/404, 407, 440, 62/448, 419, 255, 277, 279, 297, 298

[56] References Cited

U.S. PATENT DOCUMENTS

| | | | |
|---|---|---|---|
| 2,635,938 | 4/1953 | Whitney et al. | 312/46 |
| 3,210,957 | 10/1965 | Rutishauser et al. | 62/255 |
| 3,299,664 | 1/1967 | Booth | 62/419 |
| 3,366,432 | 1/1968 | Carmer | 312/236 |
| 3,712,078 | 1/1973 | Maynard et al. | 62/448 |
| 4,019,339 | 4/1977 | Anderson | 62/255 |
| 4,668,028 | 5/1987 | Kimoto | 312/116 |
| 4,776,182 | 10/1988 | Gidseg | 62/448 |
| 4,840,040 | 6/1989 | Fung | 62/255 |
| 5,347,827 | 9/1994 | Rudick et al. | 62/440 |
| 5,402,654 | 4/1995 | Rudick et al. | 62/448 |
| 5,417,079 | 5/1995 | Rudick et al . | 62/253 |
| 5,417,081 | 5/1995 | Rudick et al. | 62/440 |
| 5,433,082 | 7/1995 | Trulaske | 62/255 |
| 5,458,407 | 10/1995 | Bustos et al. | 312/116 |
| 5,461,878 | 10/1995 | Moore et al. | 62/255 |

*Primary Examiner*—William Doerrler

[57] ABSTRACT

A modular refrigeration unit comprising a condenser assembly and an evaporator assembly is bottom-mounted inside a merchandising display cooler such that cool air emerging from the evaporator assembly rises in a plenum defined between an insulated back wall of the cooler and an interior back panel. The cold air passage is centrally disposed between return warm air passages for returning air from the inside of the cabinet into the evaporator assembly. Air inlet and outlet openings are provided at selected locations on the interior back panel. The evaporator assembly is disposed above an evaporator pan which is integrally formed with a well for collecting condensed water vapor and discharging the collected moisture on the other side of a bulkhead insulating the evaporator assembly from a condenser assembly exposed to the ambient atmosphere. The liquid discharged from the evaporator pan is collected in a condensate tray disposed beneath the condenser assembly and housing a condenser coil provided in a serpentine path for carrying coolant from a compressor to a heat exchanger forming part of the condenser assembly. The condensate tray is formed with projections which support brackets that space the condenser coil from the tray so as to minimize any abrasion between the coil and the tray which could result in coolant leaks.

12 Claims, 6 Drawing Sheets

REFRIGERATION UNIT FOR COLD SPACE MERCHANDISER

FIELD OF THE INVENTION

This invention relates to a merchandising display cooler of the kind which is used in convenience stores, snack bars and restaurants for storing and cooling drinks, particularly carbonated beverages provided in cans. Typically, merchandising coolers have a vertical display area which is visible to the consumer through glass doors which may be hinged or which may slide for easy access to the display shelves. More particularly, this invention relates to the refrigeration unit used for cooling the merchandiser and to the resultant air-flow distribution in the merchandiser required to maximize cooling efficiency.

It will be understood that the refrigeration unit and dr-flow distribution will also find application in the cooling of freezer cabinets used for food products.

BACKGROUND OF THE INVENTION

As in all refrigeration units, a merchandising cooler will comprise an evaporator assembly and a condenser assembly arranged in a closed circuit such that coolant (typically Freon) is pumped to the evaporator assembly where a fan distributes incoming return air from the cabinet interior over an evaporator coil with the result that cooler air emerges from the evaporator coil and is distributed into the interior of the cabinet while gaseous coolant is withdrawn from the evaporator coil and condensed to repeat the cycle. Commonly, the condenser and evaporator assemblies are located inside the walls of the cabinet comprising the merchandiser and are positioned separately and remotely from each other, most commonly with the condenser assembly located in the base of the cabinet and the evaporator assembly located in the top of the cabinet. The origins of this arrangement are partly historical in that condensers and evaporators were often provided by respective suppliers who did not design their units to cooperate with each other. It thus became convenient to locate them separately and to complete the assembly after installation in the cabinet by providing appropriate electrical connecting means and tubular conduits for coolant flow between the condenser assembly and the evaporator assembly. The afore-mentioned "split system" has inherent disadvantages which are apparent during assembly and servicing of the cooler cabinet. It will be appreciated that the assemblies cannot be tested until fully installed in the cabinet and that, if any problems are discovered, the entire cabinet must be accommodated so that it can at least be partially disassembled and retested. Similarly, when a merchandiser which has been in use is found to be defective, the entire cabinet must be put out of service in order to carry out the appropriate repairs.

In order to overcome the previously-stated problems, modular refrigeration systems have been developed in which the condenser and evaporator assemblies are mounted on a common platform which can be easily removed from the cabinet for repair or replacement. Modular units have usually been positioned in the top of a vertical cabinet, thereby taking advantage of natural convection forces in which the warm return air naturally rises to flow over the evaporator coil and the cool air emerging from the evaporator coil falls into the cabinet.

It has been found that top-mounted modular units have some disadvantages which may be overcome by locating a refrigeration unit at the bottom of the cooler cabinet. While the forces of natural convection within the cabinet do assist the refrigeration process, these forces of course still operate outside of the cabinet where hot air rises and the ambient temperature surrounding the refrigeration unit at the top can sometimes be significantly higher than the ambient temperature at the bottom of the cabinet. It has therefore been recognized that placing a modular refrigeration unit at the bottom of the cabinet may result in a more efficient operation of the refrigeration unit. Servicing of the refrigeration unit is also easier because it is more accessible at the bottom of the cabinet than at the top where a ladder may be required to reach the refrigeration unit. Depending on the nature of the location in which the cabinet is used, there may also be a cleaner air-flow circulation around the compressor positioned at the bottom of the cabinet. Finally, the resultant raising of the vending platform is usually considered an advantage because the consumer is less likely to want to stoop down to reach a product on a bottom shelf than to stretch to reach a product on a higher shelf. It has also been found in field tests that the noise emanating from a refrigeration unit placed near the bottom of a cabinet is dissipated and is less of an intrusion on the consumer than when the refrigeration unit is placed near the top of the cabinet.

In spite of these advantages, bottom-mounted modular refrigeration units have enjoyed relatively little commercial success. Applicant has recognized the aforementioned advantages of a bottom-mounted modular refrigeration unit and redesigned the unit so that it is easier to manufacture and to service and its cooling efficiency is improved thereby meeting stringent new standards imposed by major beverage manufacturers whose products are displayed in merchandisers of this kind.

SUMMARY OF THE INVENTION

In accordance with one aspect of the invention, there is provided a modular refrigeration unit for use in an insulated cabinet, the refrigeration unit comprising a condenser assembly mounted to one side of a bulkhead and an evaporator assembly mounted to the opposite side of the bulkhead, the bulkhead and the cabinet being adapted to sealingly engage with each other so as to define an insulated compartment for containing the evaporator assembly. The condenser assembly will include conventional components comprising a compressor, a motorized fan, heat exchanger, condenser coil and condensate tray, operatively connected to each other to receive coolant from the evaporator assembly and return the coolant to the evaporator assembly in a condensed form. The evaporator assembly comprises an evaporator coil associated with a fan which directs warmer return air from the cabinet over the evaporator coil so that the emerging cool air is forced into the cabinet for distribution.

In accordance with another aspect of the invention, a back wall of the cabinet is spaced from an inner back panel which extends along the height of the interior of the cabinet, the space between the inner back panel and the back wall being vertically divided to define a central vertically extending air passage for cold air flow and two outer vertically extending air passages for return air flow, the evaporator assembly being disposed inside the cabinet so that cool air emerging from the evaporator assembly will enter the central cold air passage. The cold air passage discharges cold air into the cabinet at selected locations defined by openings formed in the inner back panel. Preferably, the openings defining a cold air exit are located at the top of the cabinet and about midway between the internal floor of the cabinet and the top. Openings disposed at selected locations on the inner back panel allow ambient air from within the cabinet to flow into the return air passages where it is aspired by the fan associated with the evaporator assembly to flow over the evaporator coil. Preferably, the openings defining the return air inlets are located adjacent to the interior floor of the cabinet.

In accordance with a further aspect of the invention, the bottom of the cabinet comprises an evaporator pan which is formed with a well to collect any condensate forming on the evaporator coil, the well having a drain hole disposed to discharge the condensate to a condensate tray disposed on the other side of the bulkhead separating the condenser assembly from the evaporator assembly. Warm ambient air flowing through the condenser assembly and warm coolant from the evaporator assembly are used to advantage in evaporating condensate and spilled liquids collected in the condensate tray.

In yet another aspect of the invention, a condensate tray is provided with means to support a condenser coil which receive coolant from the compressor, the supporting means being adapted to space the condenser coil from the operative upper surface of the condensate tray so as to minimize any abrasion between the coil and the tray arising from vibration in the coil. Preferably, the tray will comprise a series of projections which may be integrally formed with the tray and to which support means are attached comprising a pair of oppositely-directed arms, each having a termination adapted to cooperate with a loop of the condenser coil. In a preferred embodiment of the invention, the terminations have a concave upwardly-directed section adapted to cradle and receive loops of a condenser coil having a serpentine configuration. Not only is direct contact between the condenser coil and the tray avoided, the tray may be released from the condenser assembly for easy cleaning and servicing.

BRIEF DESCRIPTION OF THE DRAWINGS

In order that the invention may be more clearly understood, a preferred embodiment is described below with reference to the accompanying drawings, in which.

DETAILED DESCRIPTION WITH REFERENCE TO THE DRAWINGS

Figure 1:
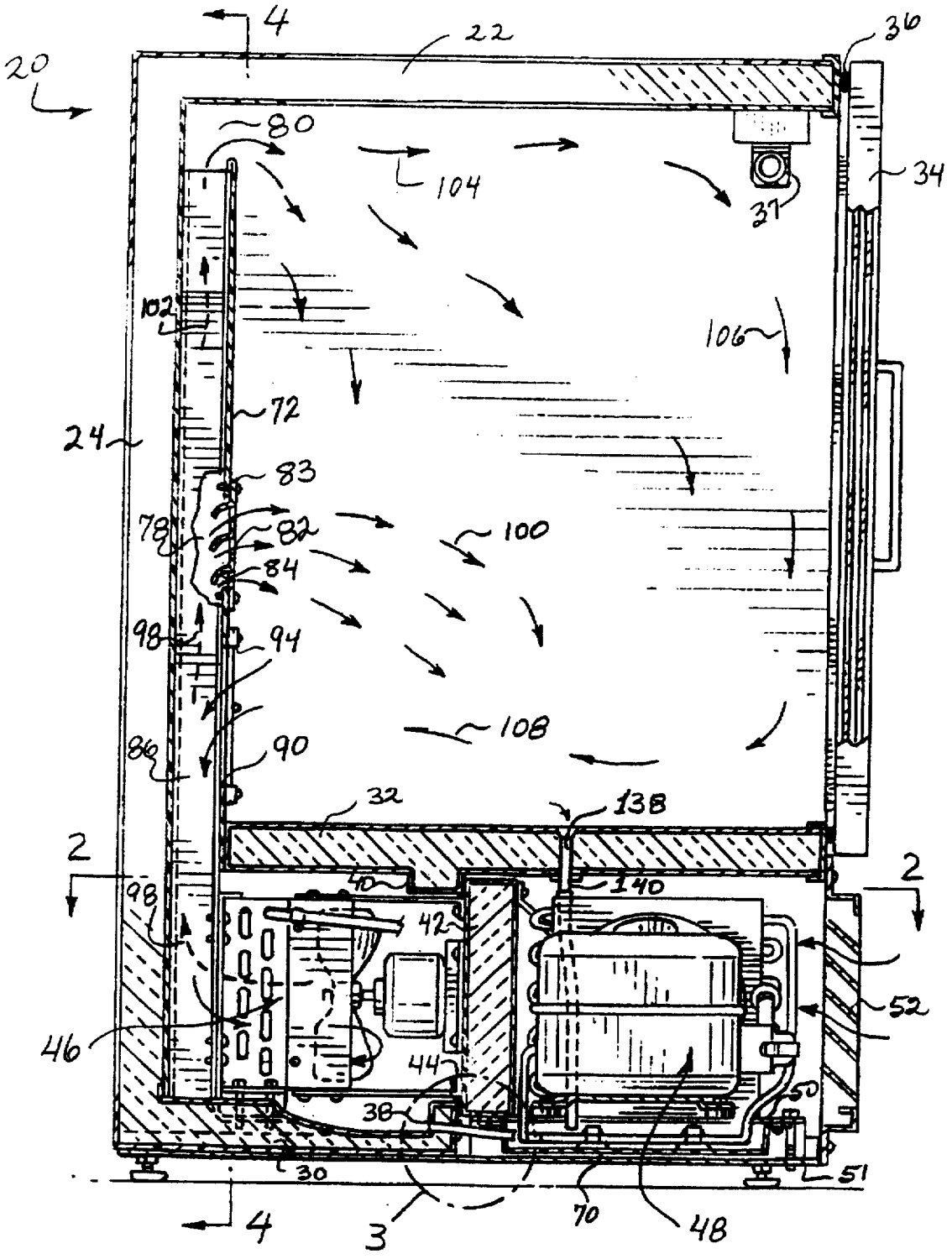
FIG. 1 is a cross-sectional view through a merchandising display cooler in accordance with the invention.
Figure 2:
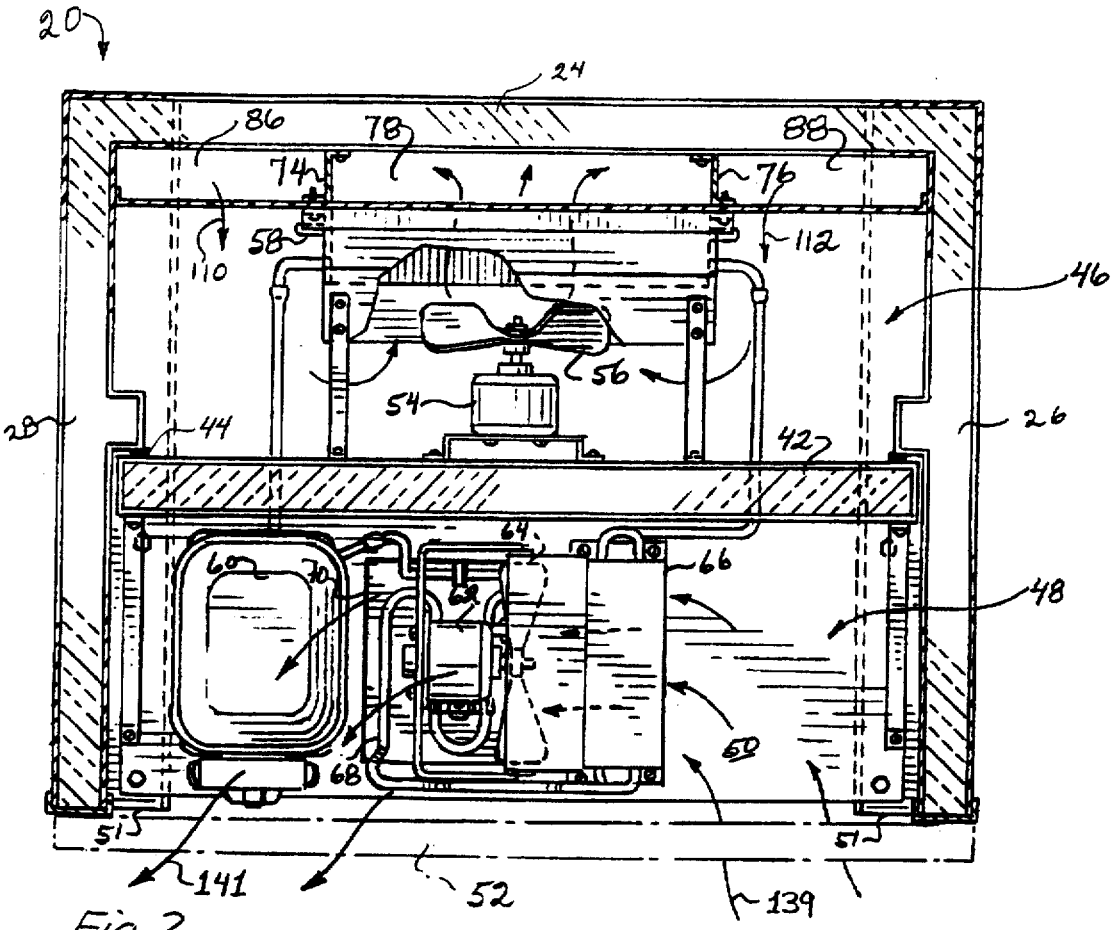
FIG. 2 is a cross-sectional view taken on line 2—2 of FIG. 1.

Referring firstly to FIGS. 1 and 2, a merchandising display cooler made in accordance with the invention comprises a cabinet generally indicated by numeral 20 having the following insulated walls: top wall 22, back wall 24, right side wall 26 (as drawn), left side wall 28 (as drawn), and bottom wall 30. An insulated interior floor 32 is vertically spaced from the bottom wall 30 so as to accommodate a refrigeration unit therebetween. A transparent door 34 is hinged to one of the side walls 26, 28 and covers the front opening of the cabinet 20 defined by the top wall 22, side walls 26, 28 and the interior floor 32. A peripheral seal 36 mounted to the door 34 keeps the interior of the cabinet 20 airtight and a light fixture 37 mounted to the top wall 22 adjacent the door 34 is provided to light the interior of the cabinet 20.

The bottom wall 30 extends forwardly from the back wall 24 only partially across the width of the cabinet 20 where it terminates in a raised portion 38 extending upwardly directly opposite from a second raised portion 40 extending downwardly from the interior floor 32. An insulated bulkhead 42 extends vertically beneath the interior floor 32 and has a peripheral seal 44 which sealingly engages the raised portions 38, 40 of the bottom wall 30 and the interior floor 32.

The refrigeration unit is comprised of an evaporator assembly generally indicated by numeral 46 and a condenser assembly generally indicated by numeral 48. The evaporator assembly 46 is mounted to one side of the bulkhead 42 so as to extend rearwardly towards the back wall 24 inside the insulated space defined between the interior floor 32 and the bottom wall 30. The condenser assembly 48 is mounted on an inverted tray 50 (FIGS. 5, 7) which also supports the bulkhead 42 at one end and which extends forwardly of the bulkhead towards the front of the cabinet 20. The tray 50 is reinforced by a pair of structural rails 51 (FIG. 4) which run the length of the side walls 26, 28. The condenser assembly 48 is thus accommodated beneath the forward portion of the interior floor 32. A cosmetically-pleasing, removable grill 52 is disposed beneath the door 34 and conceals the condenser assembly 48 from view.

The evaporator assembly 46 comprises a motor 54 mounted to the bulkhead 42 and operatively connected to drive a fan 56 disposed behind an evaporator coil 58 as is conventional in the art (FIG. 2). The condenser assembly 48 comprises a compressor 60, a motor 62 operatively connected to drive a fan 64 and a heat exchanging condenser 66 (drawn in this order from left to right in FIG. 2).

Figure 5:
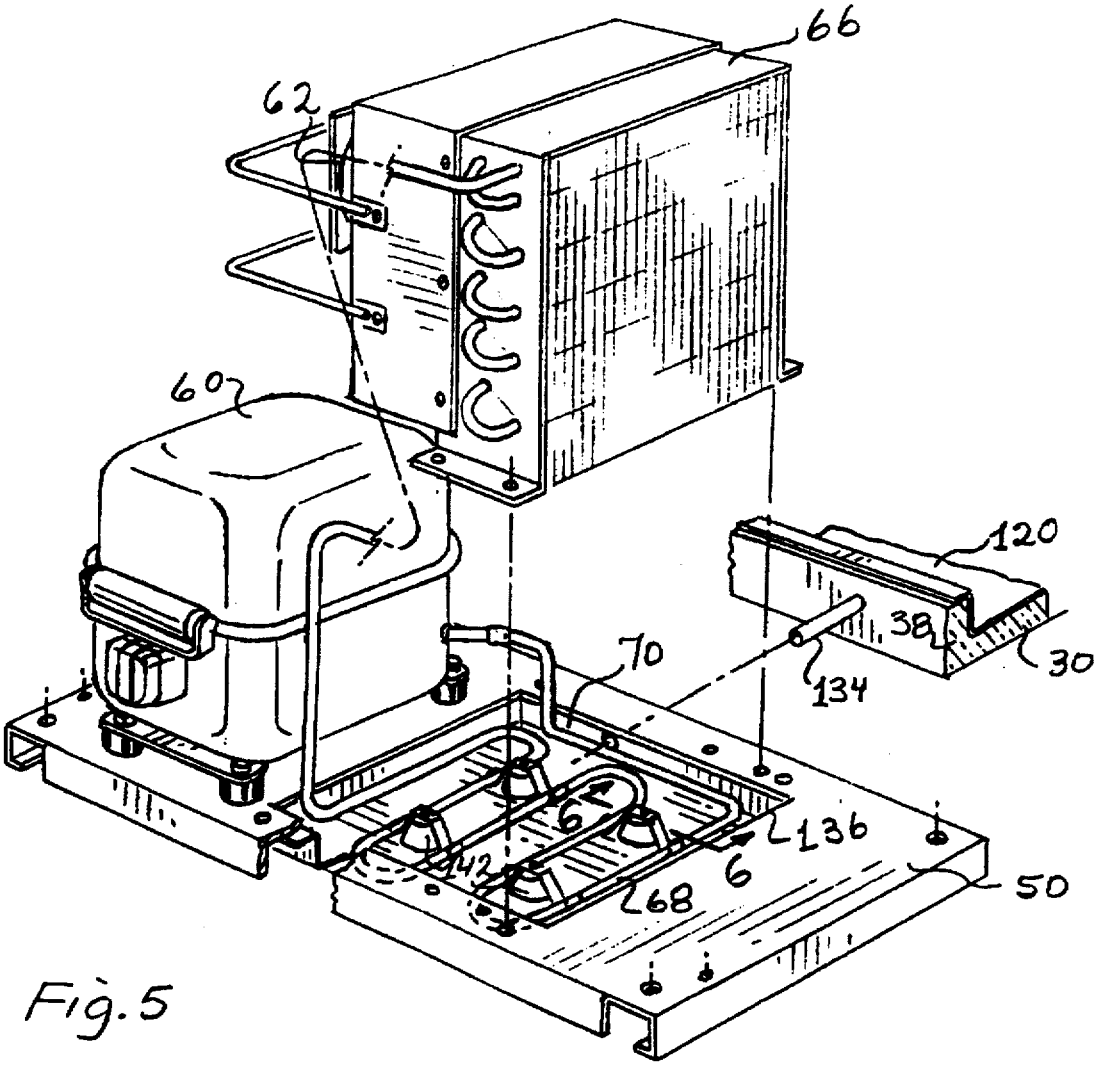
FIG. 5 is a perspective view from the front of the condenser assembly, partly exploded to reveal a condensate tray.
Figure 6:
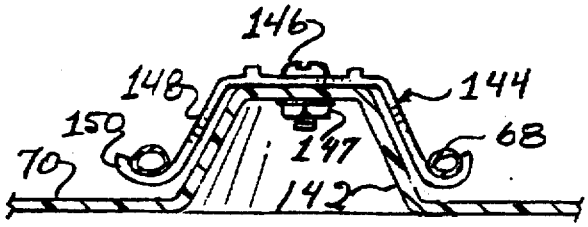
FIG. 6 is a cross-sectional view taken on line 6—6 of FIG. 5.

Coolant is circulated in a closed circuit between the evaporator assembly 46 and the condenser assembly 48, leaving the evaporator coil 58 as a gas for compression in the compressor 60. The coolant is fed from the compressor in a serpentine path through coil 68 supported inside a condensate tray 70 nested inside the inverted support tray 50 (FIG. 5). The coil 68 supplies the heat exchanging condenser 66 where the coolant is ultimately condensed to a liquid and returned to the evaporator assembly 46.

Figure 4:
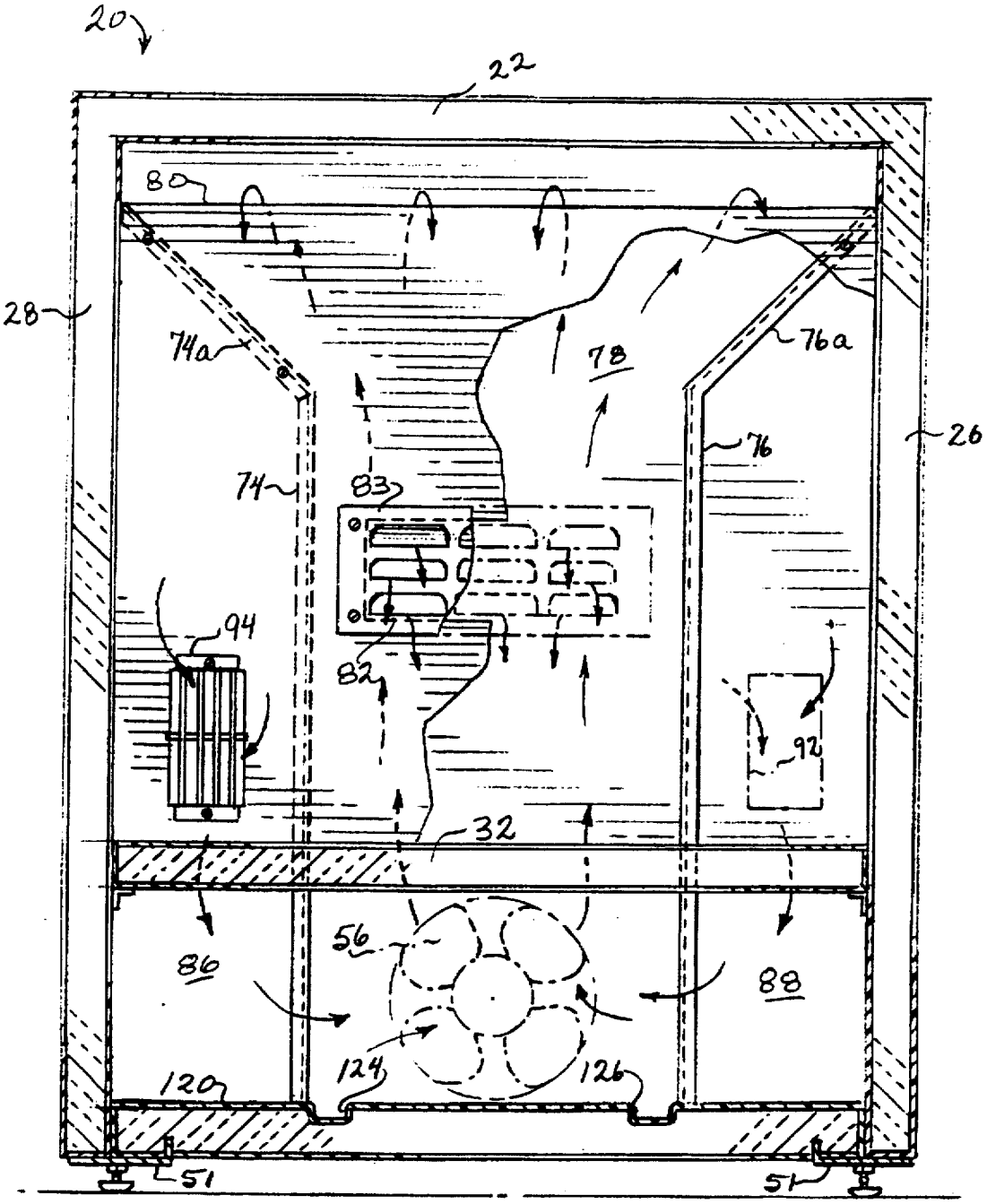
FIG. 4 is a partly-sectioned view taken on line 4—4 of FIG. 1.

The interior floor 32 is spaced from the back wall 24 and an inner back panel 72 extends along the height of the interior of the cabinet from the interior floor 32 towards the top wall 22. The space between the inner back panel 72 and the back wall 24 is approximately 6 inches wide and vertically divided by upright partitions 74, 76 (FIGS. 2, 4). The left hand partition 74 is spaced from the left side wall 28 approximately 25% of the distance separating the left side wall 28 from the right side wall 26 whereas the right side partition 76 is spaced inwardly from the right side wall 26 by the same distance of approximately 25% of the distance separating the right and left side walls. Thus a central cold air passage 78 having a width of approximately 50% of the distance separating the left and right side walls 26, 28 is defined between the left and right side partitions 74, 76. The evaporator assembly 46 is disposed inside the cabinet 20 so that cool air emerging from the evaporator coil 58 will enter the central cold air passage 78 for cold air flow.

An upper segment 74*a* of the left partition 74 is disposed at a 45° angle to join the left side wall 28 while an upper segment 76*a* of the right side partition 76 is disposed at 45° to join the fight side wall 26. Thus the cold air passage 78 covers the entire width of the insulated cabinet 20 at the top of the cabinet to provide an equalized flow of cold air over the inner back panel 72 which is spaced downwardly from the top wall 22 to define a cold air outlet opening 80 (FIG. 4). The cold air outlet opening 80 extends across the width of the panel adjacent to the top wall 22 and has a height of approximately 1½ to allow cold air to emerge from the cold air passage 78 into the refrigerated interior area of the cabinet 20.

The cold air outlet into the cabinet 20 defined by the opening 80 is supplemented by a set of supplemental openings 82 formed in the inner back panel 72 between the left and right partitions 74, 76 about midway along the height of the inner back panel. In the embodiment illustrated in FIG. 4, a set of nine supplemental openings are provided in a 3×3 array, each opening having a width of approximately 3" and a height of ⅝". A louvred grill 83 covers the supplemental openings 82 and defines respective downwardly curved air directors 84 (FIG. 1) disposed inside the cold air passage 78 and extending partly between the inner back panel 72 and the back wall 24. Left and right side return air passages 86, 88 are defined between the left side partition 74 and the left side wall 28, and the right side partition 76 and the right side wall 26 (as drawn in FIG. 2), respectively. Return air passage 86 is closed at the top by left partition segment 74*a* and return air passage 88 is closed at the top by right side partition segment 76*a*. It will be understood that the return air passages 86, 88 are in open communication at the bottom thereof with the insulated compartment for containing the evaporator assembly 46. Respective return air openings 90, 92 are provided in the inner back panel 72 so as to be in fluid communication with the return air passages 86, 88. The return air openings in this embodiment are positioned in the centre of the associated warm air passages and are spaced approximately 1" above the interior floor 32 so as to extend upwardly approximately 10" with a width of about 3". The return air openings 90, 92 are covered with respective wire grills 94, 96 adapted to allow an unrestricted flow of air from the refrigerated interior of the cabinet 20 into the return air passages 86, 88.

In use, cool air emerging from the evaporator assembly as indicated by arrows 98 shown in broken outline (FIG. 1) is forced into the central cold air passage 78 and is partially scooped by the air directors 84 for discharge through the supplemental openings 82 into the refrigerated portion of the cabinet 20 as indicated by arrows 100. A significant portion of the cool air flow indicated by arrow 102 shown in broken outline is forced over the upper portion of the inner back panel 72 and discharged through the top opening 80 as indicated by arrows 104. There is sufficient pressure in the emerging cool air 104 for at least some of this air to reach the front of the cabinet adjacent the door 34, as indicated by arrow 106, while some of the air descends into the cabinet under the influence of gravity. The return air flow as indicated by arrow 108 is directed towards the inner back panel 72 above the interior floor 32 where it enters the return air passages 86, 88 through the openings 90, 92 and is aspired by the evaporator fan 56 as indicated by arrows 110, 112, in FIG. 2 into the insulated compartment containing the evaporator assembly 46.

Thus a circulatory air flow is created with cool air rising centrally along the back wall, being discharged forwardly into the refrigerated portion of the cabinet and returned on the interior floor of the cabinet to either side of the central cold air passage where it is returned to the evaporator assembly 46 so as to repeat the cycle. The supplemental openings 82 deliver cool air directly to the bottom rear zone of the refrigerated cabinet interior and afford better temperature control in that area.

Figure 8:
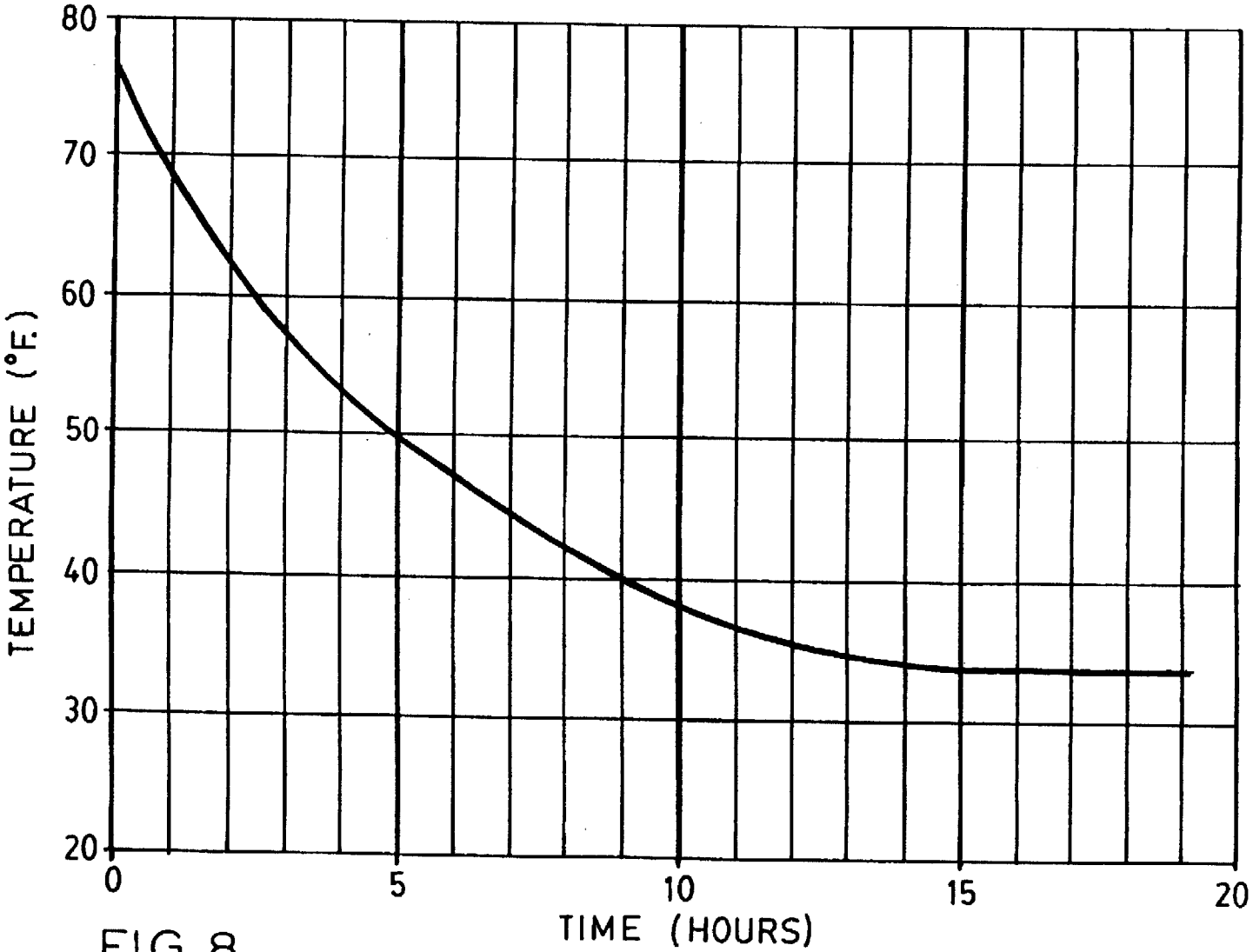
FIG. 8 is a graphical representation showing an average temperature profile inside the cooler over a 20-hour period.

Experimental tests conducted on a model of the merchandising cabinet made according to the invention produced results graphically shown in FIG. 8 of the accompanying drawings. The tests were conducted on a cabinet having six shelves carrying closely-packed soft drink cans occupying every shelf inside the cabinet. Appropriate thermocouples placed in selected cans on each shelf had their measurements recorded over a period of approximately 20 hours so as to record a temperature profile for each shelf similar to that shown in FIG. 8. The graphical representation in FIG. 8 is an average of the temperature profiles obtained for each of the six shelves and shows that it took an average period of 13 hours for the soft drink cans to reach an optimum temperature of 34° F. from an ambient starting temperature of 76° F.

It will be appreciated that the evaporator assembly 46 is enclosed by an insulated compartment defined by the insulated interior floor 32 above and the bottom wall 30 below, the insulated bulkhead 42, the insulated back wall 24 and the side walls 26, 28. By virtue of its function, the evaporator coil 58 is very cold and inevitably any moisture carried by return air aspired through the return air passages 86, 88 is condensed when it reaches the insulated aforementioned compartment for the evaporator assembly 46. Effectively, the evaporator coil 50 operates to dehumidify the air in the refrigerated portion of the merchandising cooler.

Figure 7:
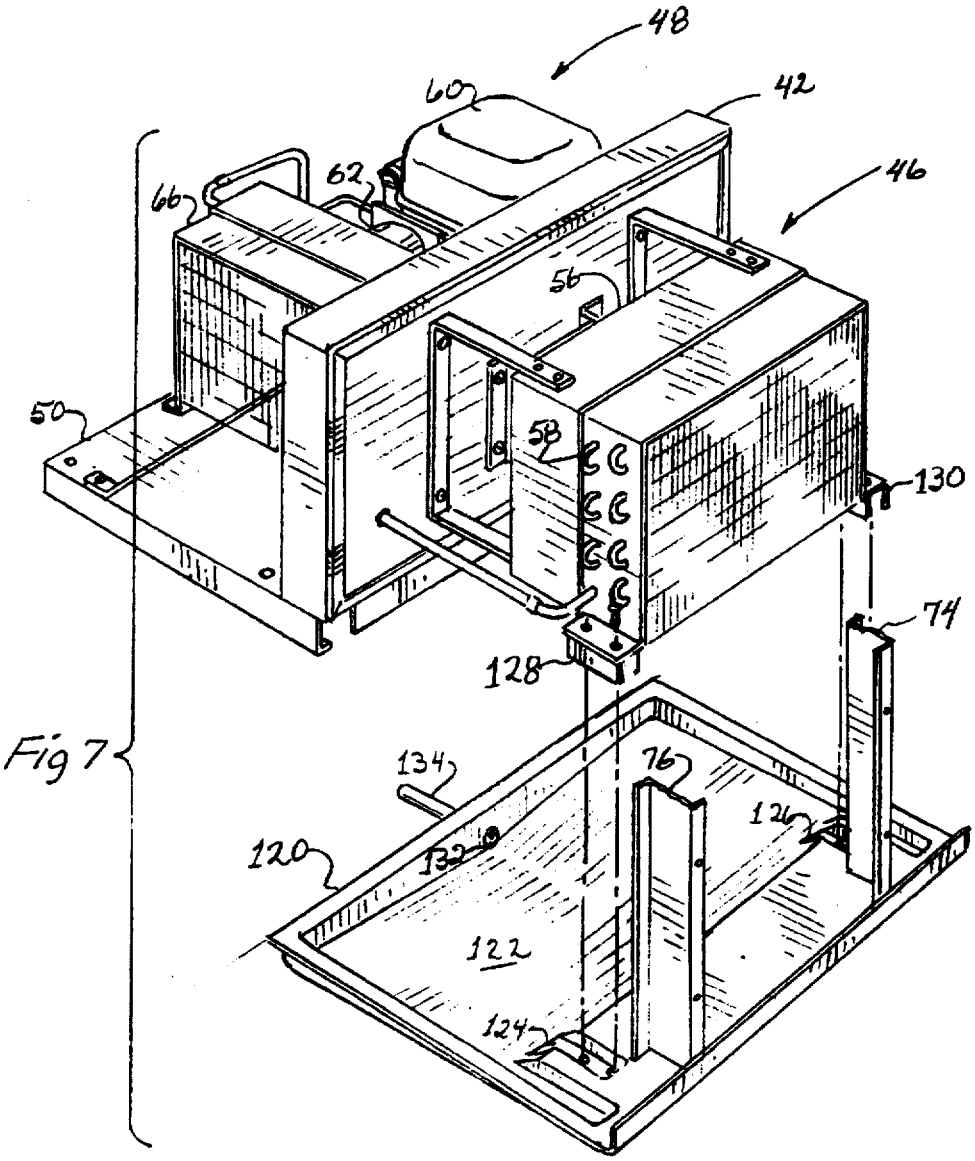
FIG. 7 is a perspective view from the rear of the evaporator assembly, partly exploded to reveal an evaporator pan.

The bottom wall 30 is lined with a vacuum formed plastic evaporator pan 120 (FIG. 7). The pan 120 is shaped to define a well 122 which, in use, is disposed beneath the evaporator assembly 46 so as to collect any condensed moisture dripping from the evaporator coil 58. The evaporator pan 120 is conveniently shaped with a pair of detents 124, 126 each disposed on opposite sides of the central air passage defined by left side partition 74 and right side partition 76. The detents are shaped to cooperate with respective inverted channels 128, 130 riveted to a casing for the evaporator coil 58 on opposite sides thereof and adapted to align with the detents 124, 126 so that the evaporator coil 58 will be positioned in the central air passage 78.

Figure 3:
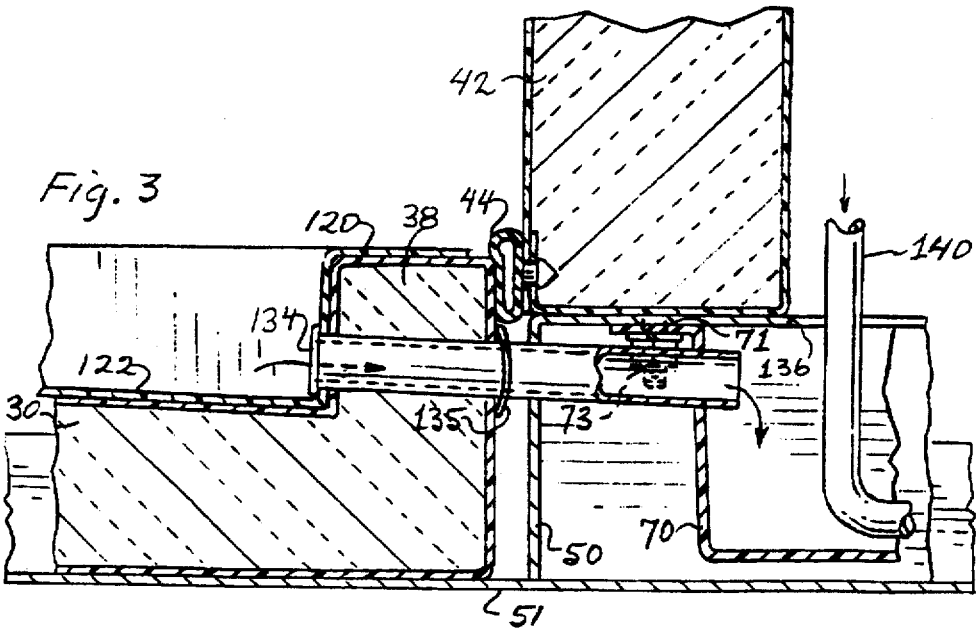
FIG. 3 is an enlarged view of circled area 3 in FIG. 1.

At the bottom of the well 122, adjacent the raised portion 38 of the bottom wall 30, a drain hole 132 formed into the evaporator pan 120 receives a drain pipe 134 (FIG. 3). The drain pipe 134 traverses the raised partition 38 of the insulated bottom wall 30 and extends beneath the bulkhead 42 where it penetrates the inverted tray 50 and the condensate tray 70. A clip 135 retains the drain pipe 134 against the raised partition 38. Any liquid collected in the well 122 is thus discharged into the condensate tray 70.

The inverted tray 50 has an opening 136 to accommodate the condensate tray 70 and which exposes the serpentine coil 68 emerging from the condenser 60. The condensate tray 70 is secured to the underside of the inverted tray 50 at a peripheral flange 71 with fasteners 73 which may be released to remove the tray 70. Condensed moisture emerging from the evaporator assembly 46 and fed through the drain pipe 134 thus collects in the condensate tray 70 to define a pre-cooling stage so as to assist in cooling gaseous coolant in the serpentine coil 68 emerging from the compressor 60 prior to entry into the heat exchanging condenser 66. Conversely, hot coolant flowing through the condenser coil 68 will assist in evaporating any condensed moisture collected in the condensate tray 70, including any liquids and condensed water vapor drained from the refrigerated interior of the cabinet. Passage 138 formed in the insulated interior floor 32 (FIG. 1) and cooperatively associated with a discharge tube 140, has its discharge end disposed in the condensate tray 70 for drainage. Evaporation of the liquids collected in the condensate tray 70 is further assisted by an ambient air flow indicated by arrows 139 as air is aspired by the fan 64 through the grill 52, adjacent the right side wall 26, and over the heat exchanging condenser 66 to exit from the condenser assembly 48 through the grill 52 adjacent the left side wall 28 as indicated by arrows 141.

It will be appreciated that there is significant vibration between the component parts of the condenser assembly 48, particularly as a result of the operation of the compressor 60. In order to obviate any undesirable relative motion between the condenser coil 68 and the associated condensate tray 70 whereby the coil could be damaged and coolant might leak, the condensate tray 70 is vacuum formed with a series of projecting risers 142 of which four are shown in the embodiment illustrated in FIG. 7. The risers 142 have a substantially truncated conical shape, each supporting a bracket 144 fixed to the truncated top of each associated riser 142 by a suitable fastener such as bolt 146 and nut 147 secured to the underside of the condensate tray 70. Each bracket 144 has a pair of oppositely-directed arms 148 each having an upwardly concave termination 150 adapted to cradle and support a loop of the condenser coil 68. The arms 148 are dimensioned so that the terminations 150 are spaced from the underlying condensate tray 70 thereby minimizing the adverse consequences of vibration resulting from the compressor 60. Conveniently, the risers 142 space the fasteners from the bottom of the condensate tray and thus minimize the occurrence of condensate leaks through the tray.

The aforementioned arrangement of the condensate tray 70 also permits the fastener 73 (FIG. 3) to be released from the inverted tray 50 so that the condensate tray 70 can be removed for cleaning or replacing, as the case may be, without removal of the heat exchanger 66 and disassembly of the condenser coil 68. Thus, the arrangement not only prolongs the useful life of the coil 68, it permits the assembly to be accessed for maintenance in a very simple and easy fashion.

It will be understood that several variations may be made to the above-described embodiment of the invention. In particular, it will be understood that the nature of the refrigeration assembly as defined by the evaporator assembly 46 and the condenser assembly 48 may vary considerably. The relative proportions of the central cold air passage and the return air passages may vary, as well as the location of the cold air outlets and return air outlets provided in the inner back panel 72 in accordance with the particular application for which the cabinet is being used. The height of the return air openings 90, 92 above the interior floor 32 could, for example, be raised to create a slightly warmer environment in the cabinet for the storage of produce such as cut flowers. Other variations within the scope of the appended claims may be apparent to those skilled in the art, the structure defined for cold air passages and warm air passages being inherently flexible to create a cooling environment adapted for any selected application.

We claim:

1. A refrigeration cabinet having insulated outer walls and an access door for accessing the cabinet interior;

a space defined between an insulated back wall and an inner panel of the cabinet, the space being vertically divided by a pair of partitions defining a central vertically-extending cold air passage for cold air flow having cold air discharge openings in fluid communication with the cabinet interior, and two outer vertically-extending return air passages for return air flow disposed on opposite sides of said cold air passage and having return air inlet openings in fluid communication with the cabinet interior, said return air inlet openings being downwardly spaced from at least some of said cold air discharge openings;

and air circulation means adapted to draw air from the cabinet interior through said return air inlet openings into said return air passages, to cool said air and to expel cool air into the cabinet interior through said cold air discharge openings from said cold air passage, a circulatory air flow being created in the cabinet interior with cool air discharged forwardly and downwardly from said inner panel and return air drawn into said return air passages for refrigeration and continued circulation.

2. A refrigeration cabinet according to claim 1 in which the inner panel of the cabinet is downwardly spaced from a top insulated ceiling for the cabinet to define a main cold air discharge opening.

3. A refrigeration cabinet according to claim 1 having return air inlet openings disposed adjacent a bottom insulated floor for the cabinet.

4. A refrigeration cabinet according to claim 2 having additional cold air discharge openings disposed at respective selected heights above a bottom insulated floor for the cabinet intermediate of the height of said main cold air discharge opening and of said return air inlet openings, said selected heights being between one quarter and three quarters of the length of the inner back panel measured between the bottom insulated floor for the cabinet and the top of the inner panel.

5. A refrigeration cabinet having insulated outer walls and an access door for accessing the cabinet interior;

a space defined between an insulated back wall and an inner panel of the cabinet, the space being vertically divided by a pair of partitions defining a central vertically-extending cold air passage for cold air flow having cold air discharge openings in fluid communication with the cabinet interior, and two outer vertically-extending return air passages for return air flow disposed on opposite sides of said cold air passage and having return air inlet openings in fluid communication with the cabinet interior, said return air inlet openings being downwardly spaced from at least some of said cold air discharge openings, said return air passages each having an upper termination spaced from an insulated upper wall, and said terminations being spaced from said insulated upper wall to define a cold air passage which broadens at the top of the cabinet;

and air circulation means adapted to draw air from the cabinet interior through said return air inlet openings into said return air passages, to cool said air and to expel cool air into the cabinet interior through said cold air discharge openings from said cold air passage, a circulatory air flow being created in the cabinet interior with cool air discharged forwardly and downwardly from said inner panel and return air drawn into said return air passages for refrigeration and continued circulation.

6. A refrigeration cabinet according to claim 1 in which the cross-sectional area occupied by the cold air passage is approximately equal to the cross-sectional area occupied by the return air passages throughout a substantial portion of the height of said passages.

7. A refrigeration cabinet according to claim 6 in which the cross-sectional area occupied by each of the return air passages is approximately 25% of the combined cross-sectional area through the cold air passage and the return air passages.

8. A refrigeration cabinet according to claim 1 having a refrigeration unit comprising an evaporator assembly and a condenser assembly mounted to opposite sides of an insulated bulkhead disposed beneath an insulated floor of the cabinet interior, the bulkhead and the cabinet being adapted to sealingly engage with each other so as to define an insulated compartment for containing the evaporator assembly, the air circulation means forming part of said evaporator assembly and comprising a fan and an evaporator disposed in said insulated compartment.

9. A refrigeration cabinet according to claim 1 having a condenser assembly which includes a condenser coil for receiving coolant from an evaporator assembly, said condenser coil being disposed in a condensate tray in serpentine path, the condensate tray having a plurality of integrally formed risers projecting upwardly from the tray, each riser supporting a bracket for holding a loop of said serpentine path, the brackets having a pair of oppositely directed arms having a concave upwardly directed termination adapted to receive the condenser coil and spaced from the condensate tray by the associated riser.

10. A refrigeration cabinet having a condenser assembly which includes a condenser coil for receiving coolant from an evaporator assembly, said condenser coil being disposed in a condensate tray in a serpentine path, the condensate tray having a plurality of integrally formed risers projecting upwardly from the tray, each riser supporting a bracket for holding a loop of said serpentine path, the brackets having a pair of oppositely directed arms having a concave upwardly directed termination adapted to receive the condenser coil and spaced from the condensate tray by the associated riser.

11. A refrigeration cabinet having insulated outer walls, and an access door for accessing the cabinet interior between an insulated floor of the cabinet interior and a top outer wall of the cabinet, the insulated floor being upwardly spaced from a bottom outer wall of the cabinet and accommodating therebetween an evaporator assembly mounted to one side of an insulated bulkhead, the bulkhead and the cabinet being adapted to sealingly engage with each other so as to define an insulated compartment for containing the evaporator assembly, a condenser assembly being mounted to the opposite side of the bulkhead, and the evaporator assembly, the bulkhead, and the condenser assembly defining a modular unit which may conveniently be removed from the cabinet for servicing.

12. A refrigeration cabinet according to claim 11 in which said bottom outer wall of the cabinet has an integrally formed evaporator pan formed with a well adapted to collect condensate forming on an evaporator coil in the evaporator assembly, the well having a drainage tube in fluid communication with a condensate tray on the other side of the bulkhead defining a pre-cooling stage to assist in cooling coolant withdrawn from the evaporator assembly.

* * * * *